US007354134B2

(12) United States Patent
Okamoto

(10) Patent No.: US 7,354,134 B2
(45) Date of Patent: Apr. 8, 2008

(54) INKJET RECORDING APPARATUS

(75) Inventor: Tsugio Okamoto, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 185 days.

(21) Appl. No.: 10/899,100

(22) Filed: Jul. 27, 2004

(65) Prior Publication Data

US 2005/0024426 A1 Feb. 3, 2005

(30) Foreign Application Priority Data

Jul. 31, 2003 (JP) ..... 2003-284581

(51) Int. Cl.
*B41J 2/165* (2006.01)

(52) U.S. Cl. ..... 347/33; 347/32; 347/35

(58) Field of Classification Search ..... 347/22–24, 347/29, 30, 32, 33, 104
See application file for complete search history.

(56) References Cited

U.S. PATENT DOCUMENTS 6,382,767 B1 5/2002 Greive

FOREIGN PATENT DOCUMENTS

| | | |
|---|---|---|
| JP | A 7-186396 | 7/1995 |
| JP | A 9-109377 | 4/1997 |
| JP | A 9-123470 | 5/1997 |
| JP | 10-217511 | 8/1998 |
| JP | A 11-207995 | 8/1999 |
| JP | 2000-103086 | 4/2000 |
| JP | A 2000-103086 | 4/2000 |
| JP | A 2000-211159 | 8/2000 |

OTHER PUBLICATIONS

Japanese Patent Application No. 2003-284581 Office Action issued Aug. 29, 2006 with translation.

*Primary Examiner*—Shih-Wen Hsieh
(74) *Attorney, Agent, or Firm*—Oliff & Berridge, PLC

(57) ABSTRACT

An inkjet recording apparatus includes a recording head, a recovery unit, a reception member, and an arrangement mechanism. The recording head ejects ink therefrom to perform recording on a recording medium. The recovery unit causes the recording head to perform a purge process. The reception member receives the ink ejected in the purge process and has flexibility. The arrangement mechanism stores the reception member, which is in a wound state, outside a recoding area where the recording head performs the recording on the recording medium. The arrangement mechanism pulls out the reception member when the recovery unit causes the recording head to perform the purge process.

15 Claims, 5 Drawing Sheets

INKJET RECORDING APPARATUS

BACKGROUND OF THE INVENTION

1. Field of the Invention

The present invention relates to an inkjet recording apparatus, and particularly relates to an inkjet recording apparatus in which ink ejected in a purge process can be received without contaminating a conveyance unit or a recording medium and in which a reception member for receiving the ink can be stored compactly so that the apparatus can be miniaturized.

2. Description of the Related Art

So-called line type inkjet recording apparatus is known as an inkjet recording apparatus for ejecting ink from nozzles of a recording head to thereby perform recording on a recording medium. In the line type inkjet recording apparatus, nozzles are formed in a long recording head so as to extend across a recording area of a recording medium. The recording medium is conveyed onto a surface opposed to a nozzle formation surface of the recording head while the recording head is fixed. Thus, recording is performed at one stroke.

In an inkjet recording apparatus that is not limited to such line type inkjet recording apparatus, the moisture in ink may be evaporated over time so that the viscosity of the ink increases, or the air may be mixed into the ink through the nozzles so that bubbles are generated in the ink. The high-viscosity ink or the bubbles will clog the nozzles to thereby impede the ink ejecting performance. In the inkjet recording apparatus, therefore, a recovery process for removing the high-viscosity ink or the like is carried out.

The recovery process is roughly divided into purging and flushing. Purging is a process for sucking ink forcibly from the recording head or supplying compressed ink forcibly to the recording head so as to discharge high-viscosity ink, pieces of dried ink, plenty of bubbles, dust, etc. generated due to long-term disuse. On the other hand, flushing is a process for discharging high-viscosity ink from the nozzles chiefly in continuous use of the apparatus. The flushing process is carried out more frequently than the purge process, but the quantity of ink discharged together with the high-viscosity ink and the like is typically smaller than that in the purge process.

For example, in the purge process in the line type inkjet recording apparatus, a preservative cap for covering the nozzle formation surface of the recording head to thereby prevent ink from being evaporated during suspension of recording is used as the reception member for receiving ink discharged from the recording head. That is, when purging is initiated, the preservative cap moves to abut against the nozzle formation surface of the recording head, and cover the nozzle formation surface to thereby form a closed space with the nozzle formation surface. The closed space is depressurized by a suction pump connected to the preservative cap so as to suck high-viscosity ink or the like from the nozzles. The high-viscosity ink or the like is discharged into the preservative cap together with ink. After the ink is discharged into the preservative cap in such a manner, the preservative cap leaves the nozzle formation surface of the recording head and returns to a predetermined position.

As for the reception member for receiving ink discharged from the recording head in the flushing process, JP-A-2000-211159 discloses a line-type inkjet recording apparatus in which a cover having an opening formed for recording is provided between a recording head and a recording medium movably forward and backward in the conveyance direction of the recording medium. In addition, JP-A-2000-211159 discloses a line-type inkjet recording apparatus in which a cover having no opening is provided between a recording head and a recording medium movably forward and backward in the conveyance direction of the recording medium. Further, JP-A-2000-211159 discloses line type inkjet recording apparatus in which a cover disposed to surround a recording head and having a cylindrical shape or the like with an opening is provided rotatably.

SUMMARY OF THE INVENTION

However, when the preservative cap receives ink discharged in the purge process, it is necessary to force the preservative cap to return to a predetermined position so as to prevent the ink from spilling from the preservative cap and to quickly separate the preservative cap from the nozzle formation surface of the recording head. This point is a constraint on designing the operation of the preservative cap.

To solve such a problem, it may also be conceived that not the preservative cap, but the cover having an opening portion receives ink discharged in the purge process as disclosed in JP-A-2000-211159. However, since a larger amount of ink than that in the flushing process is discharged in the purge process, it is likely that the conveyance unit is contaminated with the ink spilling from the opening portion of the cover. In addition, when the cover having no opening portion is moved forward and backward or when the recording head is covered with the cover formed into a cylindrical shape or the like, there is a problem that the space in which the cover is disposed becomes so large that the apparatus becomes large in size.

The invention was developed to solve the foregoing problems. The invention provides an inkjet recording apparatus in which ink discharged in a purge process can be received without contaminating a conveyance unit or a recording medium and in which a reception member that receives the ink can be stored compactly so that the apparatus can be miniaturized.

In order to the foregoing problems, according to one embodiment of the invention, an inkjet recording apparatus includes a recording head, a recovery unit, a reception member, and an arrangement mechanism. The recording head ejects ink therefrom to perform recording on a recording medium. The recovery unit causes the recording head to perform a purge process. The reception member receives the ink ejected in the purge process and has flexibility. The arrangement mechanism stores the reception member, which is in a wound state, outside a recoding area where the recording head performs the recording on the recording medium. The arrangement mechanism pulls out the reception member when the recovery unit causes the recording head to perform the purge process.

According to the above-described configuration, when the recovery unit causes the recording head to perform the purge process, the arrangement mechanism pulls out the reception member under the recording head and the reception member receives the ink ejected in the purge process. Accordingly, the ink ejected from the recording head can be prevented from contaminating a conveyance unit and the recording medium. In addition, when the recording head performs the recording on the recording medium, the arrangement mechanism stores the reception member, which is in a wound state, outside the recoding area. Accordingly, there is no fear that the reception member disturbs the conveyance of the recording medium by the conveyance unit. Further, since the arrangement mechanism stores the reception member, which is in the wound state, space for storing the reception member can be reduced in comparison with a case where the reception member is stored as it is without being wound. As a result, there is an effect that the inkjet recording apparatus can be miniaturized.

DETAILED DESCRIPTION OF THE PREFERRED EMBODIMENTS

Figure 1:
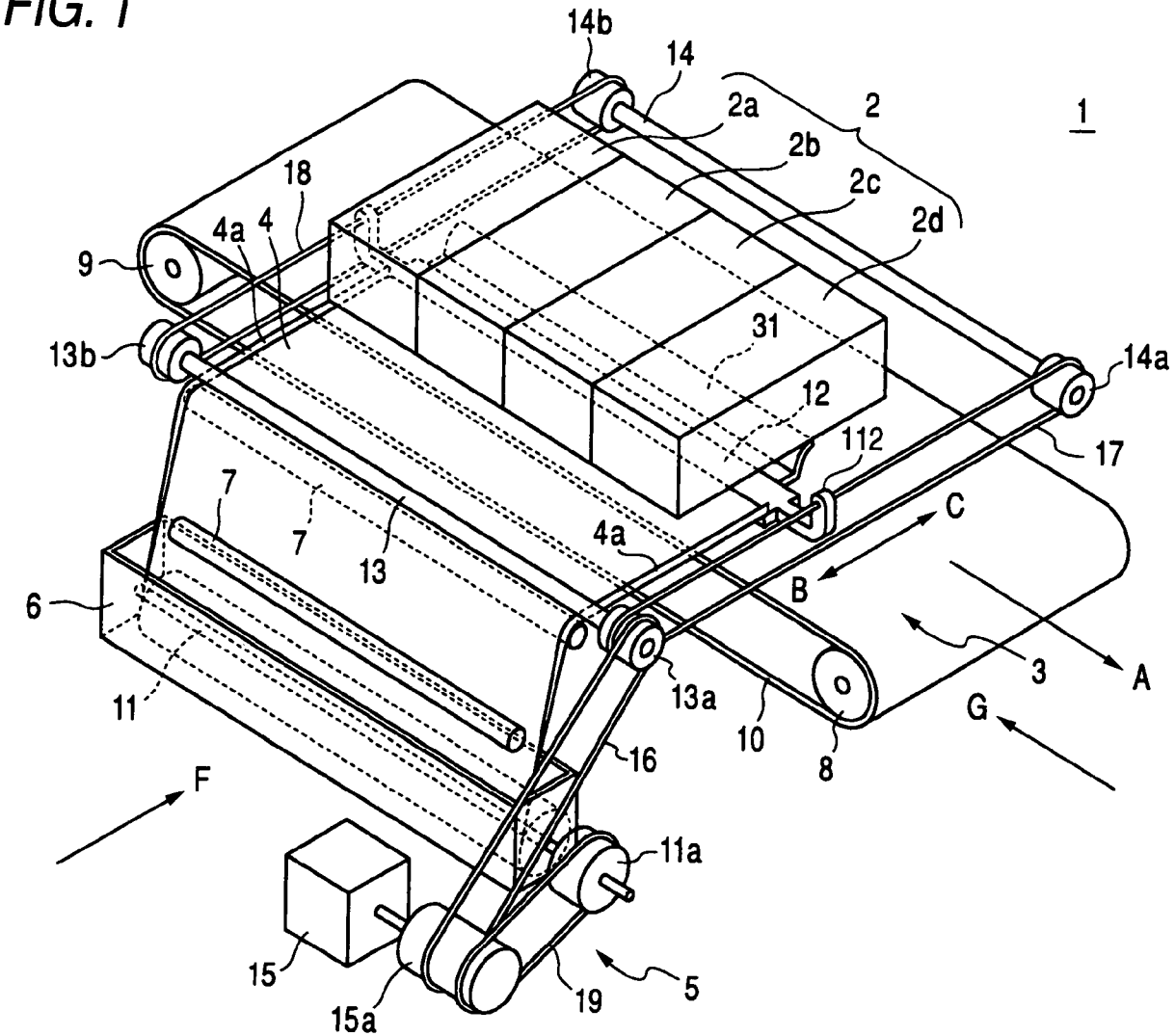
FIG. 1 is a perspective view schematically showing an inkjet recording apparatus according to an embodiment of the invention.

A preferred embodiment of the invention will be described below with reference to the accompanying drawings. FIG. 1 is a perspective view schematically showing an inkjet recording apparatus 1 according to the embodiment of the invention. In the inkjet recording apparatus 1, ink is ejected from nozzles formed in a recording head 2 so as to perform recording on a recording medium. In this embodiment, description will be made particularly on a so-called line-type inkjet recording apparatus 1 in which nozzles are formed in a long recording head 2 so as to extend across a recording area of a recording medium, and the recording medium is conveyed onto a surface opposed to a nozzle formation surface of the recording head 2 while the recording head 2 is fixed, so that recording is performed at one stroke.

The inkjet recording apparatus 1 chiefly includes a line-type recording head 2, a conveyance unit 3 disposed at a position opposed to the recording head 2, an ink reception sheet 4 disposed between the conveyance unit 3 and the recording head 2 so as to be movable forward and backward (see the arrows B and C) in a direction perpendicular to the conveyance direction (see the arrow A) of the recording medium, a sheet arrangement mechanism 5 for arranging the ink reception sheet 4 at a predetermined position, a storage box 6 that is disposed on one end side (left side in FIG. 1) of the ink reception sheet 4 and stores the ink reception sheet 4 which has been wound, and a pair of ink removal rollers 7 disposed above the storage box 6 so that the ink removal rollers 7 can abut against the ink reception sheet 4 to thereby remove ink adhering to the ink reception sheet 4. The ink removal rollers 7 is members having rigidity such as rubber, metal, and material into which ink does not sink. Incidentally, of the pair of ink removal rollers 7, one ink removal roller 7 disposed at a position opposed to the surface of the ink reception sheet 4 to which ink is discharged acts directly on the ink reception sheet 4 so as to remove the ink discharged thereto.

Though not shown, the inkjet recording apparatus 1 also includes a paper feed mechanism, a paper discharge mechanism, a preservative cap, etc. under the conveyance unit 3. The paper feed mechanism supplies the recording medium to the conveyance unit 3. The paper discharge mechanism discharges the recording medium passing through the conveyance unit 3 to the outside. The nozzle formation surface of the recording head 2 is covered with the preservative cap when recording is not performed.

The recording head 2 ejects ink onto the recording medium. The recording head 2 is constituted by four recording heads 2*a*, 2*b*, 2*c* and 2*d* corresponding to colors of cyan, magenta, yellow and black. Nozzles for ejecting ink there from are formed in the surface of each recording head 2*a* and the like facing the recording medium.

The conveyance unit 3 is a unit that conveys the recording medium to a position where the recording medium faces the nozzle formation surface of the recording head 2. The conveyance unit 3 includes a pair of belt rollers 8 and 9, a conveyance belt 10 wound on the pair of belt rollers 8 and 9, and a conveyance motor 27 (see FIGS. 2 and 4) for driving the belt rollers 8 and 9.

When the conveyance motor 27 is driven, the belt rollers 8 and 9 rotate, and the conveyance belt 10 rotates with the rotations of the belt rollers 8 and 9. The recording medium is fed onto the conveyance belt 10 from the not-shown paper feed mechanism. The conveyance belt 10 conveys the recording medium to the position where the recording medium faces the nozzle formation surface of the recording head 2. Ink is then ejected to the recording medium from nozzles corresponding to data to be recorded. Thus, recording is performed on the recording medium. After recording on the recording medium, the not-shown paper discharge mechanism discharges the recording medium to the outside of the apparatus 1.

Figure 2:
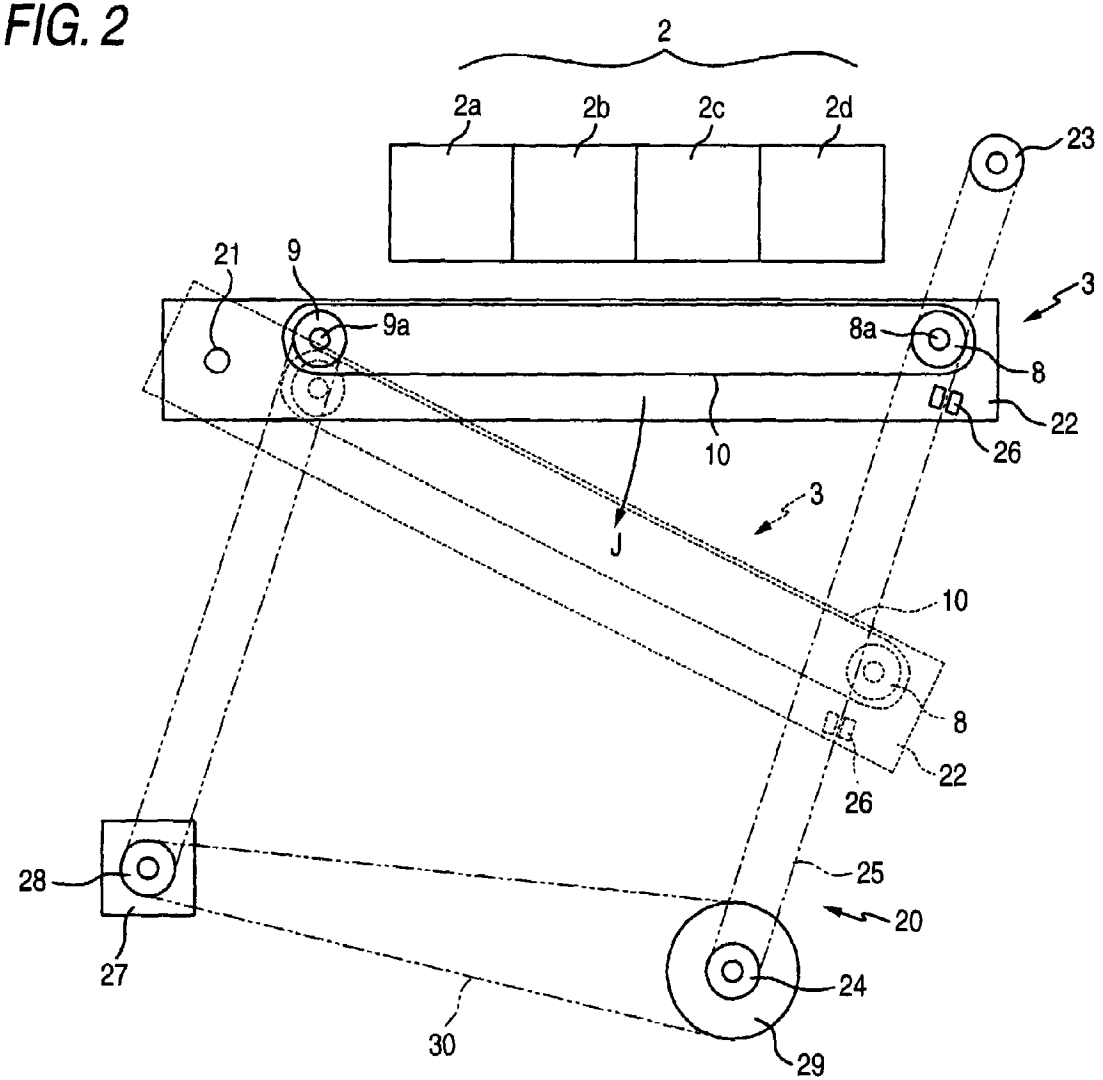
FIG. 2 is a schematic side view of the inkjet recording apparatus observed from the arrow F direction in FIG. 1.

In addition, the conveyance unit 3 is designed to be movable in a direction in which the conveyance unit 3 moves away from the nozzle formation surface of the recording head 2. Here, with reference to FIG. 2, description will be made on a movement mechanism 20 for moving the conveyance unit 3. FIG. 2 is a diagram showing the conveyance unit 3 viewed from the arrow F direction in FIG. 1. Although not shown in FIG. 1, the conveyance unit 3 is disposed in a body frame 22 having a hollow box-like shape pivotally supporting shafts 8*a* and 9*a* of the belt rollers 8 and 9, as shown in FIG. 2. The movement mechanism 20 moves the body frame 22 to thereby move the conveyance unit 3.

The movement mechanism 20 chiefly includes a reference shaft 21, a pair of moving pulleys 23 and 24, a moving belt 25, a coupling member 26, a moving clutch 63 (see FIG. 4), a transmission pulley 28 and a transmission pulley 29. The reference shaft 21 is provided erectly in a not-shown chassis and supports the body frame 22 rotatably. The moving pulleys 23 and 24 are disposed on the upper and lower sides of the body frame 22, respectively, so as to put the body frame 22 therebetween. The moving belt 25 is wound on the pair of moving pulleys 23 and 24. The coupling member 26 couples the moving belt 25 and the body frame 22 with each other. The moving clutch 63 switches the functions of the conveyance motor 27 from a power source for driving the belt rollers 8 and 9, to a power source for driving the movement mechanism 20. When the moving clutch 63 is operated, the transmission pulley 28 is coupled with the power shaft of the conveyance motor 27. A transmission belt 30 is wound on the transmission pulleys 28 and 29, and the transmission pulley 29 is attached coaxially with the moving pulley 24.

According to the movement mechanism 20, when the moving clutch 63 is activated to transmit the power of the conveyance motor 27 to the transmission pulley 28, the power is transmitted to the transmission pulley 29 through the transmission belt 30, and further transmitted from the transmission pulley 29 to the moving pulley 24. In addition, the power is transmitted from the moving pulley 24 to the moving pulley 23 through the moving belt 25. Finally the moving belt 25 wound on the moving pulleys 23 and 24 rotates. Thus, with the rotating operation of the moving belt 25, the body frame 22 (conveyance unit 3) coupled with the moving belt 25 rotates around the reference shaft 21 and in a direction (arrow J direction) in which the body frame 22 moves away from the nozzle formation surface of the recording head 2. It is noted that although the body frame 22 (conveyance unit 3) rotates around the reference shaft 21 in this embodiment, the body frame 22 (conveyance unit 3) may be configured so that it rotates around the shaft 9*a* of the belt roller 9.

Description will be kept on with reference to FIG. 1 again. The ink reception sheet 4 is a sheet for receiving ink discharged from the recording head 2 together with high-viscosity ink and the like in the purge process in which ink is pressurized and supplied to the recording head 2 so as to remove the high-viscosity ink, bubbles and the like from the recording head 2, independently of recording on a recording medium. The ink reception sheet 4 is a thin sheet, which has size equal to or larger than the nozzle formation surface of the recording head 2 and which has flexibility, plasticity and durability. Specifically, the ink reception sheet 4 is approximately 0.2 mm thick, and made from polyethylene resin impregnated with urethane resin. In addition, bank portions 4*a* folded to erect substantially vertically toward the recording head 2 are provided in both edge portions of the ink reception sheet 4 so as to extend in the arrow B and C directions, respectively.

When the purge process is initiated, the ink reception sheet 4 is arranged between the recording head 2 and the conveyance belt 10 by the sheet arrangement mechanism 5, which will be described later, so as to cover the nozzle formation surface of the recording head 2 and receive ink discharged from the recording head 2 by the purge process. In this event, the bank portions 4*a* formed in the both end portions can prevent the ink discharged onto the sheet 4 from spilling from the both edge portions and contaminating the conveyance unit 3 or the inside of the apparatus body.

At the time of recording on the recording medium, the sheet arrangement mechanism 5 winds the ink reception sheet 4 and stores the wound ink reception sheet 4 out of the recording area and inside the storage box 6. At the time of purging, the sheet arrangement mechanism 5 pulls out the wound ink reception sheet 4 between the recording head 2 and the conveyance belt 10.

The sheet arrangement mechanism 5 chiefly includes a sheet arrangement motor 15, two arrangement mechanisms and a movable member 12. The sheet arrangement motor 15 functions as a driving source for driving the sheet arrangement mechanism 5. One of the arrangement mechanisms is constituted by a pair of shafts 13 and 14 disposed on the both sides of the recording head 2 so as to put the recording head 2 therebetween, and first pulleys 13*a*, 13*b*, 14*a* and 14*b* attached to the both ends of the shafts 13 and 14, respectively. The other arrangement mechanism is constituted by a winding shaft 11 pivotally supported inside the storage box 6 so as to wind the ink reception sheet 4, and a second pulley 11*a* attached to one end portion of the winding shaft 11. The movable member 12 is provided contiguously to the to-be-pulled-out front end portion of the ink reception sheet 4.

According to the sheet arrangement mechanism 5, when the sheet arrangement motor 15 is driven, the power of the sheet arrangement motor 15 is transmitted to the second pulley 11*a* through a third pulley 15*a* attached to one end portion of the rotating shaft of the sheet arrangement motor 15, and a belt 19, so as to rotate the winding shaft 11. In addition, the power of the sheet arrangement motor 15 is also transmitted to the first pulley 13*a* through the third pulley 15*a* and a belt 16. The power transmitted to the first pulley 13*a* is further transmitted to the first pulley 14*a* through a belt 17 and to the first pulley 13*b* through the shaft 13. Finally the power rotates the belt 17 wound on the first pulleys 13*a* and 14*a* and a belt 18 wound on the first pulleys 13*b* and 14*b* in one and the same period.

The movable member 12 is coupled with the belts 17 and 18 through coupling members 112. Accordingly, with the rotating operation of the belts 17 and 18, the movable member 12 can move forward and backward (see the arrows B and C) between the recording head 2 and the conveyance belt 10 while holding the to-be-taken-out front end portion of the ink reception sheet 4. In addition, the winding shaft 11, which is synchronized with the rotating operation of the belts 17 and 18, winds the ink reception sheet 4. Accordingly, the ink reception sheet 4 can be wound smoothly. It is noted that the sheet arrangement mechanism 5 moves the movable member 12 (pulls out and retracts the ink reception sheet 4) in a direction (the arrows B and C), which is different from a direction (the arrow A) in which the conveyance unit 3 conveys the recording medium. The direction indicated by the arrows B and C may be perpendicular to that indicated by the arrow A.

Incidentally, the movable member 12 is coupled with the upper sides of the belts 17 and 18 wound on the first pulleys 13*a*, 13*b*, 14*a* and 14*b* through the coupling members 112. Thus, a relationship can be set appropriately between the moving direction of the movable member 12 and the rotating direction of the winding shaft 11 when the ink reception sheet 4 is pulled out.

Figure 3A:
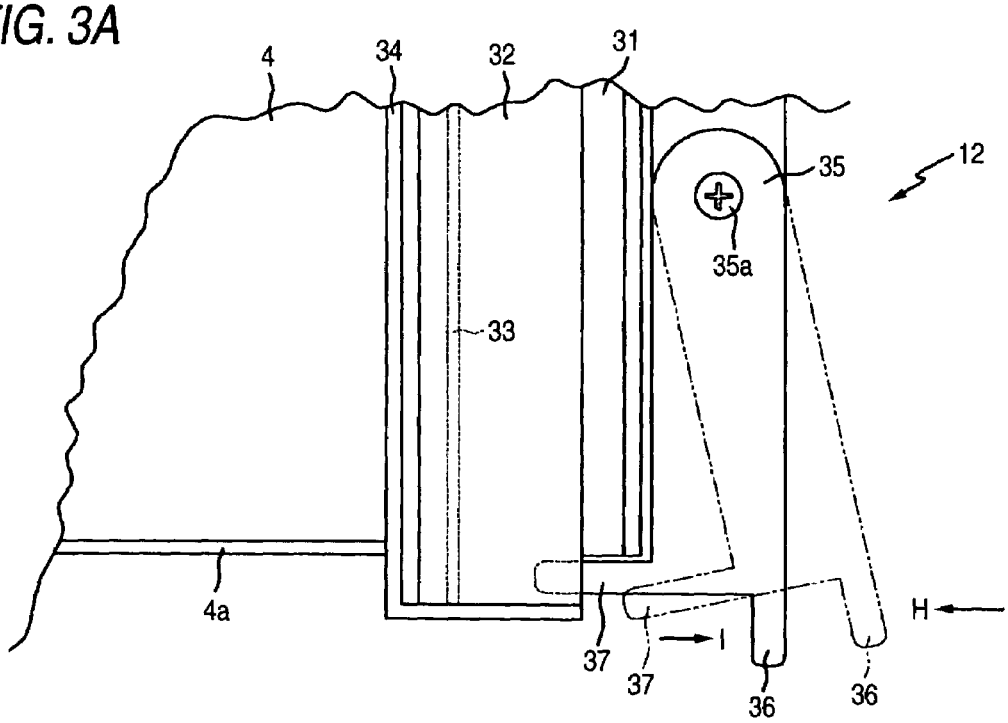
FIG. 3A is a plan view of a movable member.
Figure 3B:
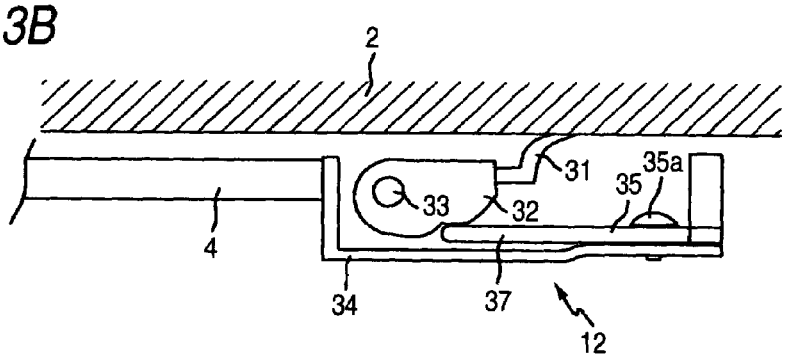
FIGS. 3B and 3C are side views of the movable member.
Figure 3C:
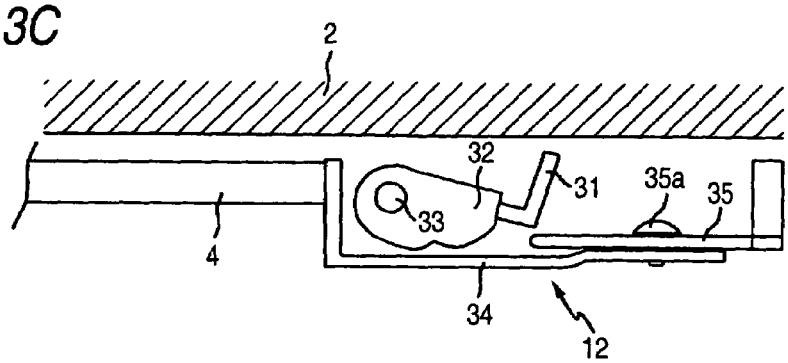

Here, the movable member 12 will be described in detail with reference to FIGS. 3A to 3C. FIG. 3A is a plan view of the movable member 12. FIG. 3B is a side view of the movable member 12, showing the state where a blade 31 retained by the movable member 12 abuts against the nozzle formation surface of the recording head 2. FIG. 3C is a side view of the movable member 12, showing the state where the blade 31 retained by the movable member 12 keeps away from the nozzle formation surface of the recording head 2.

The movable member 12 includes a blade holder 32, a shaft 33, a support member 34 and a blade operation plate 35. The blade holder 32 retains the blade 31 for cleaning the nozzle formation surface of the recording head 2. The shaft 33 pivotally supports the blade holder 32. A not-shown spring urges the shaft 33 in the clockwise direction (in FIGS. 3B and 3C), so that the bladeholder 32 is urged downwardly. The support member 34 supports the shaft 33 and the to-be-taken-out front end portion of the ink reception sheet 4. The blade operation plate 35 is pivotally supported on the front end portion of the support member 34 by a shaft fitting 35*a* so that the blade operation plate 35 can swing.

In addition, first and second collision portions (not shown) are provided as members acting on the movable member 12. The first collision portion is located in the dead end position of the movable member 12 in the arrow C direction (see FIG. 1) on the body side of the inkjet recording apparatus 1. The first collision portion collides with the right surface (in FIG. 3A) of a first protrusion 36 projecting from the blade operation plate 35 of the movable member 12, which is moving in the arrow C direction. The second collision portion is located in the dead end position of the movable member 12 in the arrow B direction (see FIG. 1) on the opposite side to the first collision portion. The second collision portion collides with the left surface (in FIG. 3A) of the first protrusion 36 of the movable member 12, which is moving in the arrow B direction.

According to the movable member 12, when the movable member 12 moves in the arrow C direction (see FIG. 1) and reaches its dead end position, the right surface of the first protrusion 36 of the blade operation plate 35 collides with the not-shown first collision portion provided on the body side. As a result, the first protrusion 36 receives a force in the arrow H direction so that the blade operation plate 35 swings around the shaft fitting 35*a*. Thus, a second protrusion 37 projecting on the blade holder side of the blade operation plate 35 hides under the bottom of the blade holder 32 (see the swing from the chain double-dashed line to the solid line in FIG. 3A). Then, the second protrusion 37 of the blade operation plate 35 lifts up the blade holder 32 pivotally supported by the shaft 33 so that the blade 31 held by the blade holder 32 abuts against the nozzle formation surface of the recording head 2 (see FIG. 3B).

As the blade 31 abuts against the nozzle formation surface, the movable member 12 is moved in the opposite direction to the aforementioned direction, that is, in the arrow B direction (see FIG. 1). When the movable member 12 reaches its dead end, the left surface of the first protrusion 36 of the blade operation plate 35 collides with the not-shown second collision portion provided on the body side. As a result, the first protrusion 36 receives a force in the arrow I direction so that the blade operation plate 35 swings around the shaft fitting 35*a*. Thus, the second protrusion 37 of the blade operation plate 35, which has hidden under the bottom of the blade holder 32, is pulled out from the bottom of the blade holder 32 (see the swing from the solid line to the chain double-dashed line in FIG. 3A). Then, since the not-shown sprint urges the shaft 33 in the clockwise direction, the blade holder 32, which has been lifted up by the second protrusion 37 of the blade operation plate 35, hangs down. As a result, the blade 31 held by the blade holder 32 is separated from the nozzle formation surface of the recording head 2 (see FIG. 3C).

Figure 4:
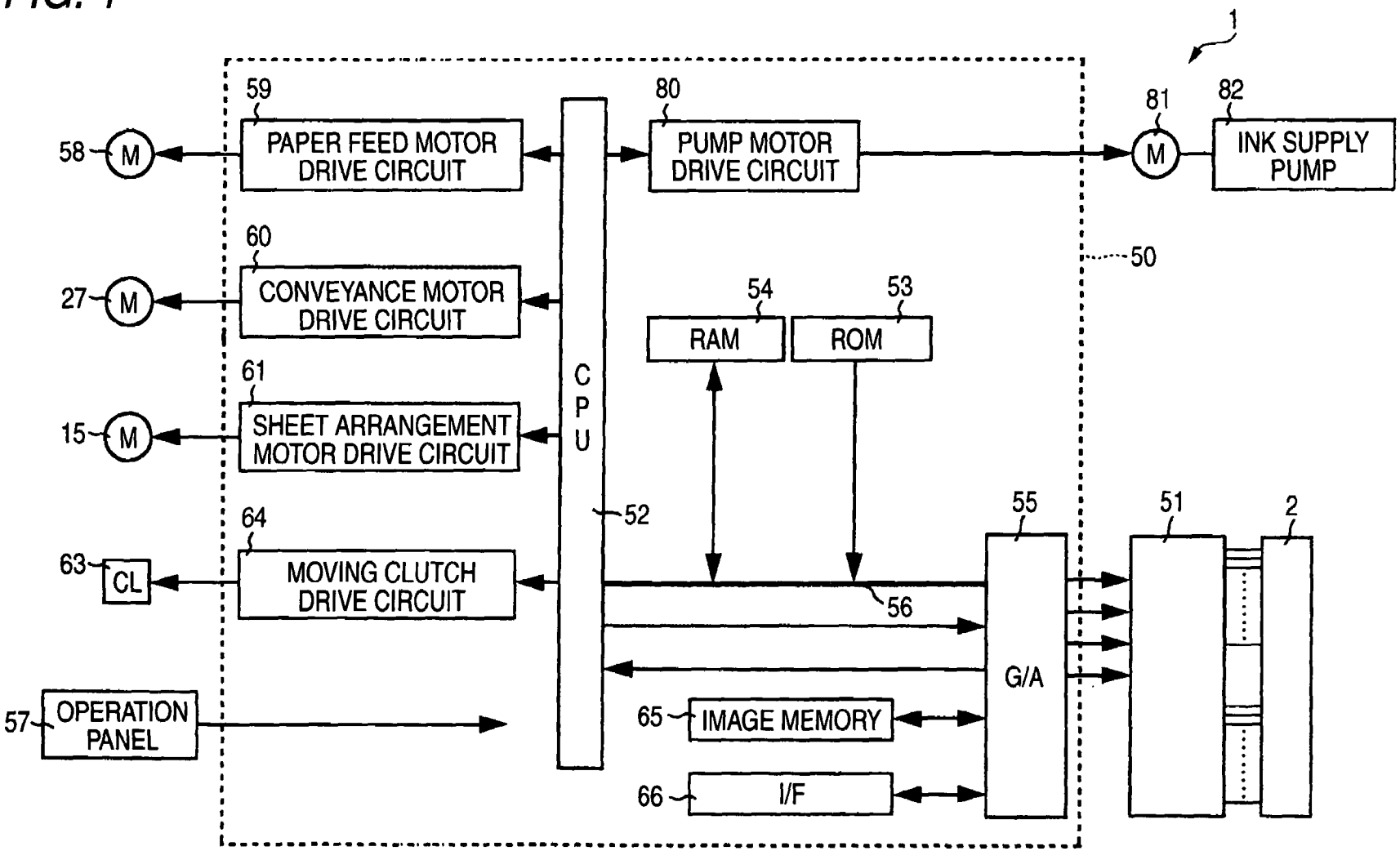
FIG. 4 is a block diagram schematically showing the electric circuit configuration of the inkjet recording apparatus.

Next, the electric configuration of the inkjet recording apparatus 1 will be described with reference to FIG. 4. FIG. 4 is a block diagram showing the outline of the electric circuit configuration of the inkjet recording apparatus 1. As shown in FIG. 4, the inkjet recording apparatus 1 includes a main control board 50, and a sub-control board 51 for controlling the recording head 2.

The main control board 50 is mounted with a microcomputer (CPU) 52, a ROM 53, a RAM 54, a gate array (G/A) 55, etc. The CPU 52 has a one-chip configuration. The ROM 53 is a read-only memory for storing fixed-value data of various control programs and the like to be executed by the CPU 52. The RAM 54 is a volatile rewritable memory for temporarily storing various data and the like. The CPU 52 is connected to the ROM 53, the RAM 54 and the G/A 55 through a bus line 56.

The CPU 52 functioning as an arithmetic unit executes various processes in accordance with the control programs stored in ROM 53 in advance. A program related to the purge process is also stored in the ROM 53, and controlled by the CPU 52. In addition, the CPU 52 generates a printing timing signal and a reset signal, and transfers the signals to the G/A 55, which will be described later.

In addition, an operation panel 57, a paper feed motor drive circuit 59, a conveyance motor drive circuit 60, a sheet arrangement motor drive circuit 61, a moving clutch drive circuit 64, a pump motor drive circuit 80, etc. are connected to the CPU 52. A user gives instructions for printing and the like through the operation panel 57. The paper feed motor drive circuit 59 drives a paper feed motor 58 for supplying power to the paper feed mechanism. The conveyance motor drive circuit 60 drives the conveyance motor 27 for supplying power for moving the conveyance unit 3 while supplying power to the belt rollers 8 and 9. The sheet arrangement motor drive circuit 61 drives the sheet arrangement motor 15. The moving clutch drive circuit 64 drives and controls the moving clutch 63. The pump motor drive circuit 80 drives an ink supply motor 81 to supply power to an ink supply pump 82. The ink supply pump 82 supplies ink from not-shown ink cartridges to the recording head 2*a*-2*d*. The CPU 52 controls the operation of each device thus connected.

The G/A 55 outputs print data (driving signal), a transfer clock, a latch signal, a parameter signal and an ejection timing signal in accordance with the printing timing signal transferred from the CPU 52 and image data stored in an image memory 65. The image data is printed on the recording medium based on the print data. The transfer clock is synchronized with the print data. A reference printing waveform signal is generated from the parameter signal. The ejection timing signal is outputted in a constant period. The G/A 55 transfers those signals to the sub-control board 51 mounted with a head driver.

In addition, the G/A 55 stores image data into the image memory 65. The image data is transferred from external equipment such as a computer through an interface (I/F) 66. The G/A 55 generates a data reception interrupt signal based on data transferred from a host computer or the like through the I/F 66, and transfers the data reception interrupt signal to the CPU 52. Incidentally, each signal communicated between the G/A 55 and the sub-control board 51 is transferred through a harness cable connecting the both.

The sub-control board 51 is a board for driving the recording head 2 through a head driver (drive circuit) mounted on the sub-control board 51. The head driver is controlled through the G/A 55 mounted on the main control board 50, so as to apply a drive pulse of waveform corresponding to a recording mode to each drive element of the recording head 2. Thus, a predetermined amount of ink is ejected from each nozzle to the recording medium.

Description will be made on the operation of the inkjet recording apparatus 1 configured thus, in the recording process. When an instruction to execute the recording process is given by the CPU 52, the storage box 6 stores at least part of the ink reception sheet 4 with the at least part of the ink reception sheet 4 wound around the shaft 11 and the movable member 12 is located outside a recording region where the recording head 2 ejects ink onto the recording medium. Accordingly, the ink reception sheet 4 does not disturb the recording process in which the recording head 2 ejects ink onto the recording medium. Also, space for storing the reception member (that is, the size of the storage box 6) can be reduced in comparison with a case where the ink reception sheet 4 is stored as it is without being wound.

Figure 5A:
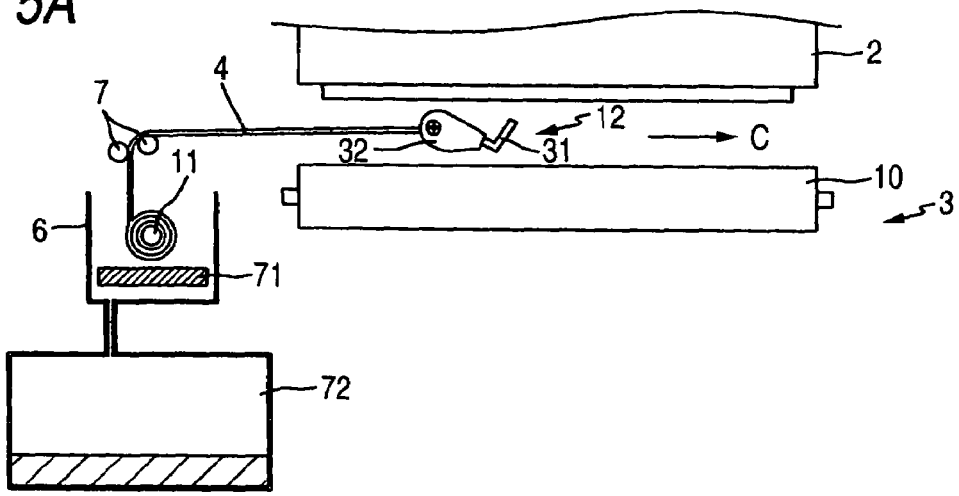
FIGS. 5A to 5C are schematic side views of the inkjet recording apparatus observed from the arrow G direction in FIG. 1, showing the motion of an ink reception sheet in a purge process in time series.
Figure 5B:
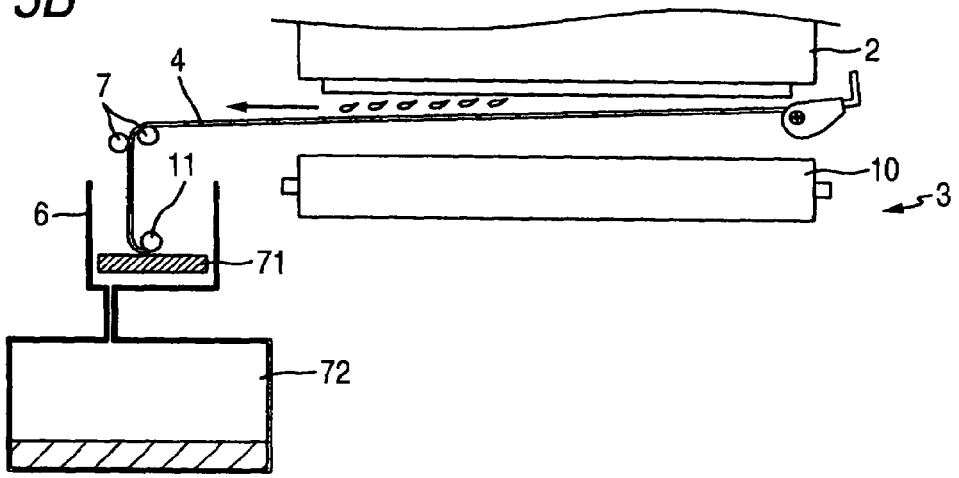
Figure 5C:
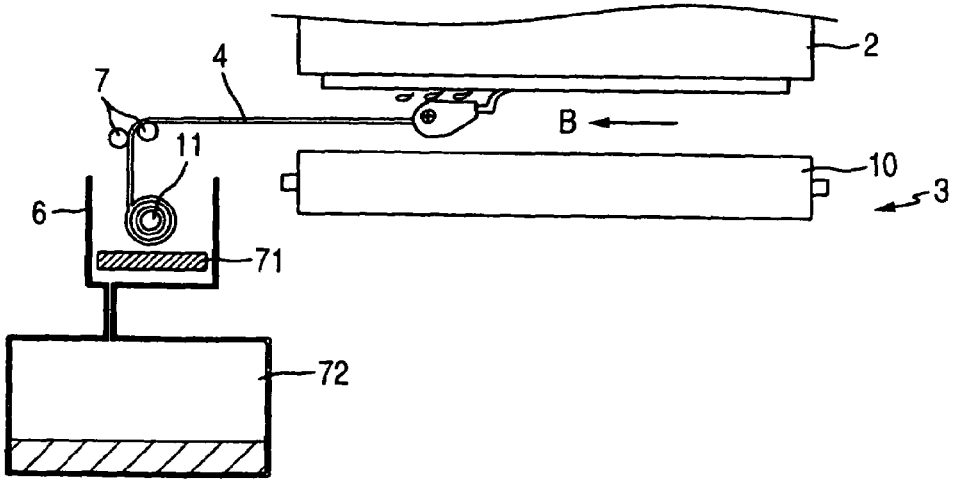

Next, description will be made on the operation of the inkjet recording apparatus 1 configured thus, in the purge process, with reference to FIGS. 5A to 5C. FIGS. 5A to 5C are schematic side views of the inkjet recording apparatus 1 observed from the arrow G direction in FIG. 1, showing the motion of the ink reception sheet 4 in the purge process in time series. The purge process is activated in accordance with disuse for a time not shorter than a predetermined time or in response to a specific instruction given by the user. The purge process is executed on the basis of the program, which relates to the purge process and is stored in the ROM 53 in advance.

When an instruction to execute the purge process is given by the CPU 52, the moving clutch 63 operates to supply the power of the conveyance motor 27 to the movement mechanism 20. As a result, the movement mechanism 20 moves the conveyance unit 3 so that the conveyance unit 3 moves apart from the nozzle formation surface of the recording head 2. Thus, a wider space than that during recording onto the recording medium is formed between the recording head 2 and the conveyance belt 10. Accordingly, the ink reception sheet 4 can be arranged easily with inclining between the recording head 2 and the conveyance belt 10. Also, constraints on design can be reduced in comparison with the case where the ink reception sheet 4 is disposed in the narrow space before the movement of the conveyance unit 3.

When the conveyance unit 3 has moved, the sheet arrangement motor 15 is driven. Thus, the movable member 12 moves in the arrow C direction so that the ink reception sheet 4 wound on the winding shaft 11 in the storage box 6 is pulled out between the recording head 2 and the conveyance belt 10. In this event, the blade holder 32 of the movable member 12 moves while the blade holder 32 is hanging down on the conveyance unit 3 side, so that there is no fear that the blade 31 held by the blade holder 32 abuts against the nozzle formation surface of the recording head 2 (see FIG. 5A). Accordingly, the blade 31 does not disturb the movement of the ink reception sheet 4, but the ink reception sheet 4 can be pulled out to the predetermined position smoothly.

When the movable member 12 keeps moving in the arrow C direction, the movable member 12 reaches the dead end position in the arrow C direction on the body side of the apparatus 1, and abuts against the body. Then, the first protrusion 36 of the blade operation plate 35 hides under the bottom of the blade holder 32 so as to lift up the blade holder 32. Thus, the blade 31 held by the blade holder 32 abuts against the nozzle formation surface of the recording head 2. In addition, the position of the movable member 12, which is moving in the arrow C direction, is set to be higher than the position of the pair of ink removal rollers 7. Accordingly, the ink reception sheet 4 pulled out between the recording head 2 and the conveyance belt 10 is arranged so that the ink reception sheet 4 is gradually apart from the nozzle formation surface of the recording head 2 as approaching from its to-be-taken-out front end portion to the storage box 6.

Incidentally, when the movable member 12 moves in the arrow C direction, the rotation transmitted to the second pulley 11*a* is prevented from being transmitted to the winding shaft 11 due to a not-shown one-way clutch.

During the purge operation, the ink supply pump 82 rotates at larger revolution numbers than a normal recording state so as to compress and supply a large amount of ink to the recording head 2. When the ink is compressed and supplied to the recording head 2 in this state, the ink is discharged from the nozzles onto the ink reception sheet 4. The ink reception sheet 4 is formed to be large enough to cover the nozzle formation surface of the recording head 2, while the bank portions 4*a* are formed in the both edge portions of the ink reception sheet 4, respectively. Accordingly, the ink reception sheet 4 can receive the discharged ink surely so that the conveyance unit 3 or the like disposed under the ink reception sheet 4 can be prevented from being contaminated.

Since the ink reception sheet 4 is disposed with inclining, the ink discharged thus onto the ink reception sheet 4 flows down freely toward the storage box 6 and is received in the storage box 6 smoothly. In addition, since the ink absorbing member 71 is provided in the storage box 6, the ink received in the storage box 6 is absorbed into the ink absorbing member 71. Incidentally, ink beyond the absorbing capacity of the ink absorbing member 71 is discharged to a waste tank 72 communicating with the storage box 6.

When the ink is discharged from the recording head 2 in such a manner, the sheet arrangement motor 15 is driven in the opposite way to the aforementioned way, so as to retract the movable member 12 in the arrow B direction. In this event, the ink reception sheet 4 is wound on the winding shaft 11 so that the storage box 6 stores the ink reception sheet 4. In the course of the retraction, the ink removal rollers 7 remove ink adhering to the surface of the ink reception sheet 4. Thus, the ink reception sheet 4 can be prevented from being left dirt. Also, there is no fear that the ink adhering on to the ink reception sheet 4 flies out and contaminate the inside of the inkjet recording apparatus 1.

Although the ink reception sheet 4 is wound, the blade 31 moves while abutting against the nozzle formation surface of the recording head 2. Accordingly, the blade 31 wipes out the nozzle formation surface having ink adhering thereto due to the purge process. Thus, the operation of winding the ink reception sheet 4 to thereby retract it in the storage box 6 and the operation of cleaning the nozzle formation surface can be carried out concurrently. It is therefore possible to improve the time efficiency in comparison with the case where both the operations are carried out separately. Incidentally, the ink wiped out by the blade 31 flows along the blade 31 and is collected through the flow path of the ink reception sheet 4, the storage box 6, the ink absorbing member 71 and the waste tank 72 in the same manner as described above. Accordingly, when the blade 31 wipes out the nozzle formation surface of the recording head 2, the inside of the apparatus can be prevented from being contaminated with the wiped ink.

When the movable member 12 reaches the dead end position in the arrow B direction, the first protrusion 36 of the blade operation plate 35 hiding under the bottom of the blade holder 32 is pulled out. Thus, the blade holder 32 hangs down so that the blade 31 is separated from the nozzle formation surface, getting ready for the next purge process.

In addition, the ink reception sheet 4 is wound on the winding shaft 11 so that the ink reception sheet 4 can be stored in a saved space in spite of its wide surface. Further, the winding shaft 11 is located outside the conveyance path of the recording medium and disposed in the storage box 6. Accordingly, there is no fear that the retracted ink reception sheet 4 interrupts the conveyance of the recording medium. Further, the inside of the apparatus can be prevented from being contaminated with the ink adhering to the ink reception sheet 4.

Although the invention has been described above based on its embodiment, the invention is not limited to the embodiment at all. It can be easily imagined that various modifications or changes can be made without departing from the gist of the invention.

For example, water repellant treatment may be applied to the surface of the ink reception sheet 4.which will receive ink, so as to make the ink on the ink reception sheet 4 flow down smoothly toward the storage box 6.

The mechanism for moving the conveyance unit 3 by means of the movement mechanism 20 is not limited to the one described in the embodiment. For example, the mechanism may be adapted to move the conveyance unit 3 up and down in parallel to the recording head.

The mechanism for removing the ink on the ink reception sheet 4 is not limited to the ink removal rollers 7. The mechanism may be a scraper, a rubber plate, or the like, for scraping the ink on the ink reception sheet 4.

What is claimed is:

1. An inkjet recording apparatus comprising:

a recording head that ejects ink therefrom to perform recording on a recording medium;

a recovery unit that causes the recording head to perform a purge process;

a reception member that receives the ink ejected in the purge process and has flexibility; and an arrangement mechanism that stores the reception member, which is in a wound state, in a wound position outside a recording area where the recording head performs the recording on the recording medium, and that pulls out the reception member from the wound position to a position under the recording head and retracts the pulled-out reception member to the wound position, wherein the arrangement mechanism pulls out the reception member to the position under the recording head when the recovery unit causes the recording head to perform the purge process, wherein the arrangement mechanism includes a shaft, wherein at least part of the reception member is wound around the shaft in the wound state, wherein the reception member wound around the shaft is pulled out to the position under the recording head, the reception member including a reception region capable of receiving the ink ejected from the recording head at the position under the recording head, and wherein at least a part of the reception region of the pulled-out reception member is again wound around the shaft when the pulled-out reception member is retracted to the wound position.

2. The inkjet recording apparatus according to claim 1, further comprising:

a conveyance unit that conveys the recording medium to a position where the recording medium faces a nozzle formation surface of the recording head, wherein:

the arrangement mechanism pulls out the reception member to a position between the recording head and the conveyance unit when the recovery unit causes the recording head to perform the purge process; and the recording head ejects a predetermined amount of the ink in the purge process.

3. The inkjet recording apparatus according to claim 2, wherein:

the arrangement mechanism includes a movement member that is continuous with an end portion of the reception member and is movable reciprocally between the recording head and the conveyance unit while holding the reception member; and the movement member includes a cleaning unit that wipes out the nozzle formation surface of the recording head when the arrangement mechanism retracts the reception member.

4. The inkjet recording apparatus according to claim 3, wherein when the reception member is pulled out between the recording head and the conveyance unit, the reception member is gradually apart from the recording unit as approaching from the end portion to the storage portion.

5. The inkjet recording apparatus according to claim 4, wherein the reception member includes bank portions at both edges thereof, which are parallel to a movement direction of the movement member.

6. The inkjet recording apparatus according to claim 3, wherein: the arrangement mechanism includes: a pair of belts extending in a direction in which the arrangement mechanism pulls out the reception member;

pulleys on which the belts are wound;

a motor that supplies to the pulleys power for rotating the belts; and coupling members that couple the belts with the movement members, respectively.

7. The inkjet recording apparatus according to claim 6, wherein when the arrangement mechanism winds the reception member around the shaft to retract the reception member, the motor supplies to the shaft power for rotating the shaft.

8. The inkjet recording apparatus according to claim 2, further comprising:

a movement mechanism that moves the conveyance unit so that the conveyance unit moves apart from the nozzle formation surface of the recording head, wherein:

after the movement mechanism has moved the conveyance unit, the arrangement mechanism pulls out the reception member to a position between the recording head and the conveyance unit.

9. The inkjet recording apparatus according to claim 2, wherein: the arrangement mechanism pulls out and retracts the reception member in a first direction different from a second direction in which the conveyance unit conveys the recording medium.

10. The inkjet recording apparatus according to claim 9, wherein the arrangement mechanism pulls out and retracts the reception member in the first direction, which is perpendicular to the second direction in which the conveyance unit conveys the recording medium.

11. The inkjet recording apparatus according to claim 1, wherein the purge process recovers ink after ink-ejection performance by the recording head.

12. The inkjet recording apparatus according to claim 1, further comprising:

a storage portion that stores at least a part of the reception member in the wound state.

13. The inkjet recording apparatus according to claim 12, further comprising:

an absorbing member that absorbs the ejected ink, which the reception member receives.

14. The inkjet recording apparatus according to claim 1, further comprising:

a removal mechanism that removes the ink, which is ejected onto and adheres to the reception member.

15. An inkjet recording apparatus comprising:

recording means for ejecting ink therefrom to perform recording on a recording medium;

recovery means for causing the recording head to perform a purge process;

reception means for receiving the ink ejected in the purge process, the reception means having flexibility; and arrangement means for storing the reception means, which is in a wound state, in a wound position outside a recording area where the recording means performs the recording on the recording medium, and for pulling out the reception means from the wound position to a position under the recording means and for retracting the pulled-out reception means to the wound position, wherein the arrangement means pulls out the reception means to the position under the recording head when the recovery means causes the recording means to perform the purge process, wherein the arrangement means includes a shaft, wherein at least part of the reception means is wound around the shaft in the wound state, wherein the reception means wound around the shaft is pulled out to the position under the recording head, the reception means including a reception region capable of receiving the ink ejected from the recording means at the position under the recording means, and wherein at least a part of the reception region of the pulled-out reception means is again wound around the shaft when the pulled-out reception means is retracted to the wound position.

* * * * *